United States Patent [19]

Nishinuma

[11] Patent Number: 4,975,668

[45] Date of Patent: Dec. 4, 1990

[54] ELECTROMAGNETIC FOCUSING

[75] Inventor: Terumi Nishinuma, Ageo, Japan

[73] Assignee: Kanto Denshi Kogyo Co., Ltd., Ageo, Japan

[21] Appl. No.: 341,947

[22] Filed: Apr. 20, 1989

[30] Foreign Application Priority Data

Apr. 26, 1988 [JP] Japan ..... 63-102928
Aug. 24, 1988 [JP] Japan ..... 63-210351

[51] Int. Cl.[5] ..... H01F 7/00
[52] U.S. Cl. ..... 335/210; 315/5.35; 335/306
[58] Field of Search ..... 315/5.34, 5.35; 335/210, 212, 306, 302, 303

[56] References Cited

U.S. PATENT DOCUMENTS 4,731,598 3/1988 Clarke ..... 335/306
4,829,276 5/1989 Leupold ..... 315/5.35

*Primary Examiner*—George Harris
*Attorney, Agent, or Firm*—William B. Kempler

[57] ABSTRACT

A permanent magnet for an electric lens including at least two ring-shaped permanent magnets, wherein a yoke comprised of a ferromagnetic body having the same inner and outer diameters of adjacent ring-shaped permanent magnets to be inserted into a portion between said both ring-shaped permanent magnets, and said yoke is comprised of a sintered alloy and is provided with one groove or more for taking out a lead wire of a coil assembled in said yoke and said ring-shaped permanent magnets.

5 Claims, 5 Drawing Sheets

ELECTROMAGNETIC FOCUSING

BACKGROUND OF THE INVENTION

1. Field of the Invention

This invention relates to an improvement in a permanent magnet for an electronic lens used for e.g., electron beam control of a cathode-ray tube for a projector.

2. Prior Art

For a device of this kind, there has been already proposed a first prior art shown in FIG. 5 as the side cross sectional view.

As shown in FIG. 5, a ring-shaped permanent magnet 1 as an electronic lens is fitted on a neck portion 8 of a cathode-ray tube (glass bulb) so as to render the lens effect to an electron beam emitted toward the front side of the electron gun, and to allow an image on the fluorescent surface to have a small spherical aberration and produce no halation.

This permanent magnet 1 is magnetized as shown in a Z-axis direction, i.e., in an axial direction along which an electron beam travels. Onto both magnetic pole end surfaces, ring-shaped flat plate like magnetic pole plates 2*a*, 2*b* of magnetic body are bonded. These plates are circumferentially fitted in a manner that the inner circumferential surface of the ring-shaped permanent magnet 1 is slightly spaced from the outer circumferential surface of the neck portion 8. An electron beam 9 emitted from the cathode 4 toward the anode 7 travels while adjusted by first and second grids 5 and 6 on the way to pass through an inner hole of the electron lens (permanent magnet 1). As a result, the electron beam 9 is focused to reach the fluorescent surface (not shown).

FIG. 6 shows the construction of the first prior art of the electron lens wherein FIG. 6(*a*) is a side cross sectional view and FIG. 6(*b*) is a front view. Further, FIG. 4 is an actual measurement characteristic curve diagram of the width of the magnetic density curve in a direction of the electron beam showing the length in a direction of the electron beam of the permanent magnet and the half-value of the maximum magnetic flux density in an electron lens comprised of a permanent magnet alone.

A second prior art is disclosed in the Japanese patent application laid open No. 211940/86.

In all drawings, the same reference numerals denote the same or corresponding members, respectively.

It is disclosed in the second prior art (shown in FIG. 8 as the side cross sectional view) that a permanent magnet for an electronic lens comprises at least two ring-shaped permanent magnets 1*a*, 1*b*, . . . which are individually magnetized and are connected in the same magnetic pole direction, and the half-value width of the magnetic flux density distribution on the Z-axis of the permanent magnets 1*a*, 1*b* . . . have 80 to 200% of the inner diameters of the permanent magnets. In this example, reference numerals $2_{1a}$, $2_{1b}$, $2_{2a}$ and $2_{2b}$ all denote magnetic pole pieces, respectively.

However, in the case of the structure of the electronic lens shown in the above-mentioned first prior art, as shown in FIG. 7, the magnetic flux density distribution diagram in the Z-axis direction from the magnetic pole piece 2*a* to the magnetic pole piece 2*b* is represented by the magnetic flux density curve 15.

When an attempt is made to set the width in the Z-axis direction indicating the half-value 15*b* of the value 15*a* at which the magnetic flux density is maximized (which is referred to as "half-value width") to a fairly good value, e.g., about 26 mm, the length (thickness) in the Z-axis direction of the permanent magnet of FIG. 6(*a*) must be considerably elongated. For this reason, the permanent magnet is difficult to manufacture, and becomes expensive.

On the other hand, it is seemingly true that the second prior art has eliminated the drawbacks with the first prior art.

FIG. 9 is a magnetic flux density distribution diagram in the second prior art of FIG. 8 wherein the magnetic flux density curve 17 shows the distribution in the Z-axis direction from the magnetic pole piece $2_{1a}$ to the magnetic pole piece $2_{2b}$, and 17*a* and 17*b* represent the magnetic flux density maximum value and the half-value of the maximum value, respectively. Plotting in FIG. 8 is made in comparison with the first prior art.

However, the second prior art is only considered as means adapted so that the permanent magnet of the first prior art is divided into two sections to manufacture them as the permanent magnets 1*a* and 1*b*, respectively, to connect these magnets in the Z-axis direction. Although the manufacturing cost is somewhat reduced in the case of the second prior art, there is not so positively appraised improvement from a viewpoint of the use requirement of a large quantity of permanent magnets of the expensive member, its operation or effect, and the advantage indicating to what degree the second prior art has been advanced as compared to the first prior art.

In the case of an electronic lens of this kind, a control scheme is employed to allow a direct current to flow in the excitation coil to superimpose a magnetic flux in the same direction as the direction of a magnetic field produced by the permanent magnet to control the value of the direct current, thus to adjust the strength of the magnetic field.

FIG. 11 shows the construction of a permanent magnet to which means according to this invention provided with a yoke 3 of a ferromagnetic body is applied, wherein a lead wire 17 for supplying a current to the excitation coil is connected to a coil 15 wound onto a bobbin 14 via a take-out hole 16 bored or opened in the magnetic pole piece 2*a*.

For this reason, it is required to ordinarily provide a take-out hole 6 on one side of the magnetic pole piece 2*a* or 2b.

For ordinary magnetic pole piece or yoke, soft iron such that the content of carbon is less than 0.3% is used.

However, the provision of the take-out hole 16 for taking out the lead wire 17 to the outside in the magnetic pole piece 2*a* allows the physical condition of the magnetic pole piece 2*a* to be uneven, resulting in disturbed or inhomogeneous strength distribution of the magnetic field based on the magnetic flux 9.

In addition, because soft iron such that the content of carbon is less than 0.3% is used as the magnetic pole piece or the yoke, where a high frequency magnetic field is produced in the vicinity thereof, an undesirable elevation of temperature due to eddy current loss would take place.

SUMMARY OF THE INVENTION

With the above in view, an object of this invention is to provide a permanent magnet for an electric lens which has completely eliminated the drawbacks with the above-mentioned prior arts and is capable of constituting an ideal electronic lens with a small quantity of permanent magnets.

In this invention, a yoke for effectively guiding magnetic flux is held between expensive upper and lower two permanent magnets (the portion close to the electron gun is referred to as "upper" portion, and the portion close to the fluorescent surface is referred to as "lower portion"), thereby permitting this permanent magnet to have the same action/effect as those of a permanent magnet constructed so that the length in the Z-axis direction which is the electron beam direction of the permanent magnet is elongated.

Since the permanent magnet according to this invention is constituted as above, a single permanent magnet considered to be formed by the outside both end surfaces of the two permanent magnets will serve as a permanent magnet elongated in the Z-axis direction as a result of the fact that magnetic flux passing through the yoke comprised of a ferromagnetic body put therebetween and joined thereto is hardly demagnetized, so the spacing between the both magnetic pole piece is substantially elongated by the thickness of the yoke.

In this invention, a method is also employed to make up, using a sintered body of a sintered member, a ring-shaped yoke consisting of, e.g., material containing Si element and having an electric intrinsic resistance increased so that it is above 20 microohm·centimeters, and provided with one or two grooves for taking out the lead wire to the outside to hold the ring-shaped yoke between the both ring-shaped permanent magnet ends, thus to form a permanent magnet for an electronic lens.

Since the permanent magnet for electronic lens is constituted as above, where the lead wire of the coil assembled therein is caused to be introduced to the outside, there is no possibility that the magnetic field distribution is disturbed even when a take-up pole for the lead wire is provided in the magnetic pole piece, and it is easy to open grooves in the end portion of the ring-shaped yoke because of the sintered alloy.

In addition, it is also easy to increase the intrinsic resistance by the constituent added such as Si element because of the sintered alloy.

DESCRIPTION OF THE PREFERRED EMBODIMENT

Figure 1:
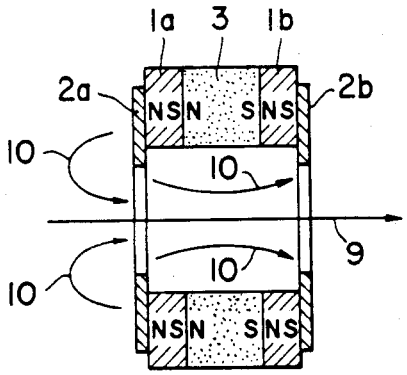
FIG. 1 shows the construction of the essential part of an embodiment according to this invention wherein FIG. 1(*a*) is a side cross sectional view and FIG. 1(*b*) is a front view.
Figure 1:
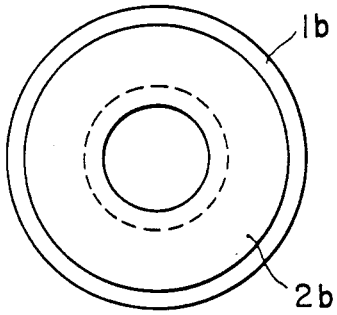

FIG. 1 shows the construction of the essential part of an embodiment according to this invention wherein FIG. 1(*a*) is a side cross sectional view and FIG. 1(*b*) is a front view.

In this first embodiment, ring-shaped members consisting of Alnico (Alnico 8 . . . tradename . . . ) and having an outer diameter of 59 mm, an inner diameter of 48 mm, and a thickness of 8 mm are formed as the permanent magnets 1*a* and 1*b*, respectively. To the outside both end surfaces thereof, ring-shaped magnetic pole pieces 2*a* and 2*b* consisting of a ferromagnetic body each having an outer diameter of 56 mm, an inner diameter of 33 mm, and a thickness of 3 mm are joined and fixed.

The essential point of this invention resides in that a yoke 3 consisting of a ferromagnetic body and having substantially the same outer and inner diameters as those of the permanent magnets 1*a* and 1*b* is held or put between the inside both end surfaces of the permanent magnets 1*a* and 1*b* and a length of the yoke 3 in the Z-axis direction is about from half to three times compared with one of the permanent magnets 1*a* and 1*b*, these proportional values of the yoke 3 in the Z-axis to the permanent magnet 1*a* or 1*b* being shown in FIG. 1(*a*). In this example, the magnetic polarities N and S indicated at the both end portions in the Z-axis direction of the yoke 3 in FIG. 1(*a*) are polarities of the magnetic fields induced by the permanent magnets 1*a* and 1*b*.

Figure 4:
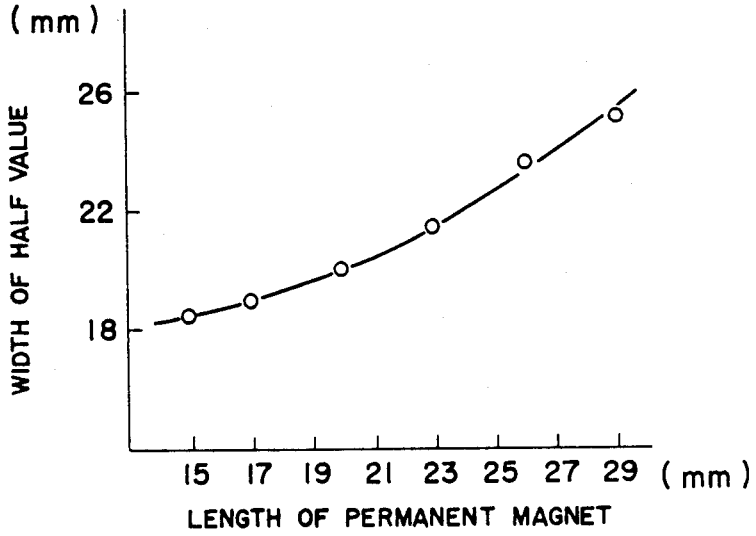
FIG. 4 is an actual measurement characteristic curve diagram of the width of the magnetic flux density curve in the electron beam direction showing the length in the electron beam direction of a permanent magnet and the half-value of the maximum magnetic flux density in an electronic lens comprised of only permanent magnet.
Figure 5:
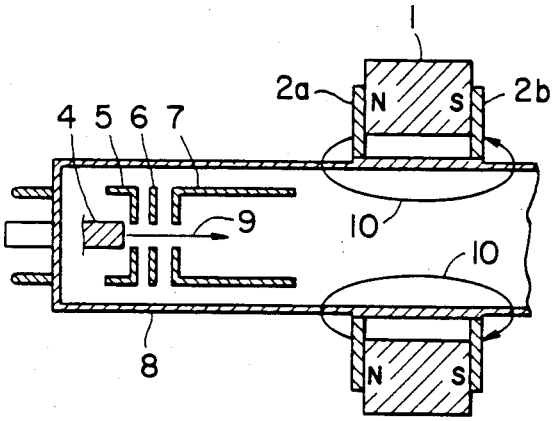
FIG. 5 PRIOR ART
FIG. 5 is a side cross sectional view of a conventional device of this kind.
Figure 6A:
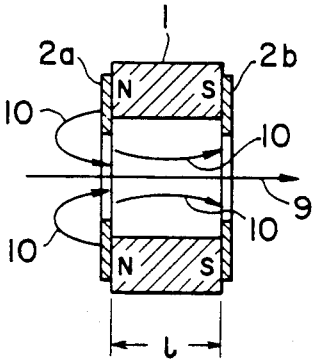
FIG. 6A PRIOR ART
FIG. 6 shows the construction of first prior art of the electronic lens wherein FIG. 6(*a*) is a side cross sectional view and FIG. 6(*b*) is a front view.
Figure 6B:
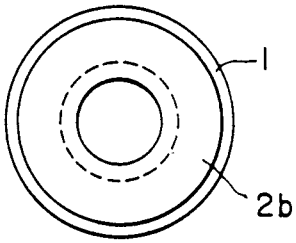
FIG. 6B PRIOR ART
Figure 7:
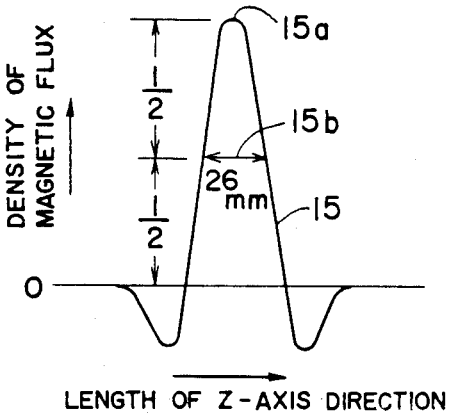
FIG. 7 is a magnetic flux density distribution diagram of the above-mentioned first prior art wherein the abscissa represents the length (mm) in the Z-axis direction and the ordinate represents the magnitude of the magnetic flux density and the direction of the magnetic field.
Figure 8:
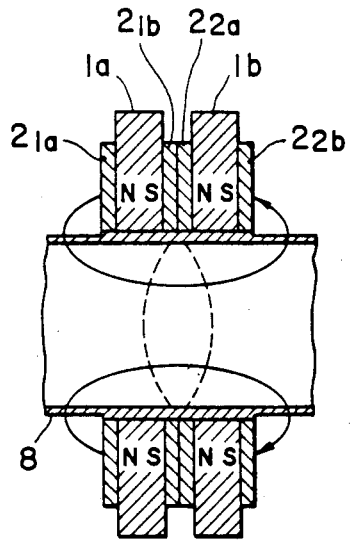
FIG. 8 PRIOR ART
FIG. 8 is a side cross sectional view showing the construction of a second prior art of the electronic lens.
Figure 9:
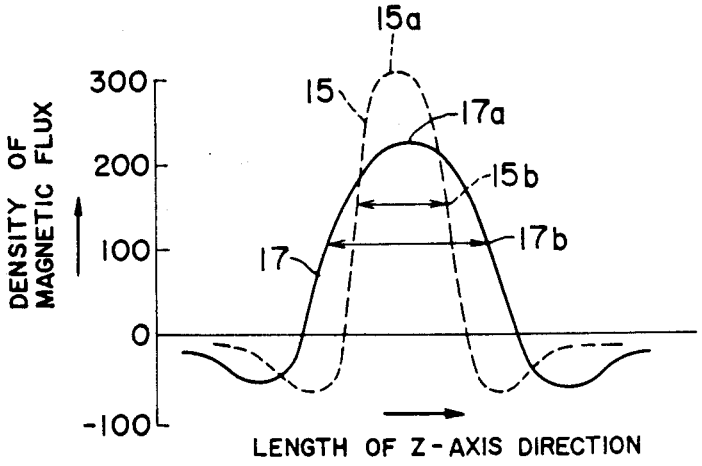
FIG. 9 is a magnetic flux density distribution diagram of the above-mentioned second prior art wherein the abscissa represents the length (mm) in the Z-axis direction and the ordinate represents the magnitude of the magnetic flux density and the direction of the magnetic field.
Figure 10:
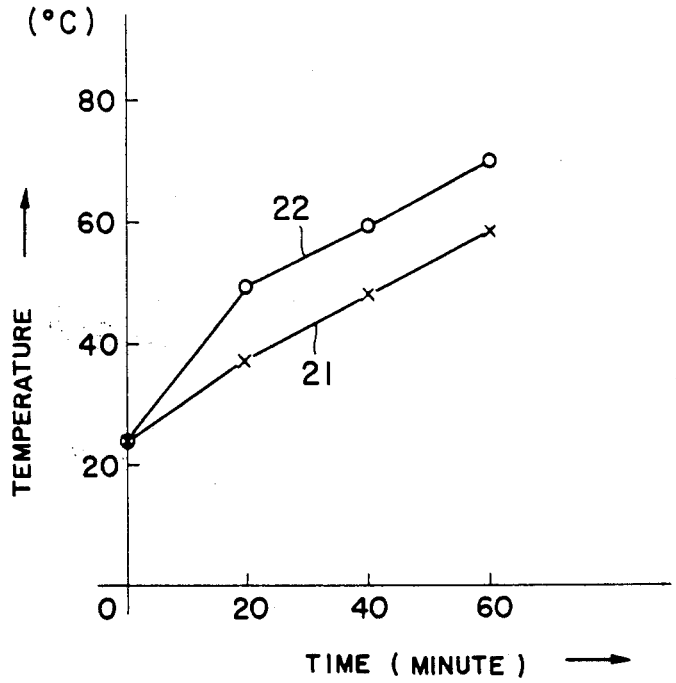
FIG. 10 is a graph showing, in a comparative manner, an elevation of temperature based on eddy current loss by the method of this invention (broken lines 21) and the conventional method (broken lines 22).
Figure 11A:
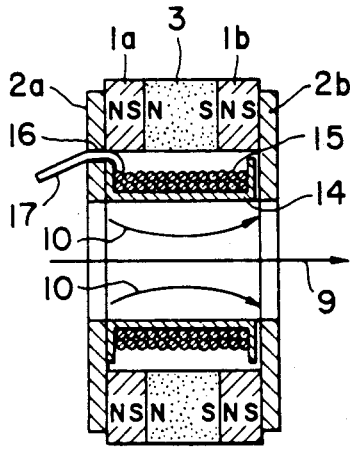
FIG. 11 is a side cross sectional view showing the method of taking out, by the conventional means, the lead wire of the excitation coil wound within the permanent constituted as an embodiment according to this invention.
Figure 11B:
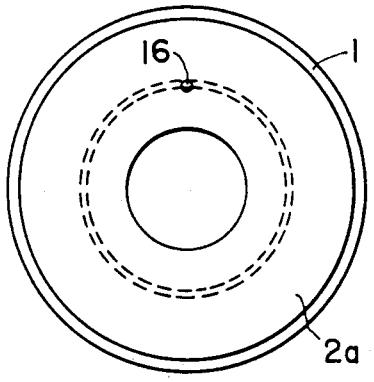
PRIOR ART FIG. 11(b)

Meanwhile, FIG. 4 is a half-value width characteristic curve diagram of the above-mentioned first prior art wherein the length (mm) of the permanent magnet 1 of FIG. 6 is taken as a parameter of the abscissa and the change (mm) of half-value width is taken as a parameter of the ordinate. (It is true that substantially the same characteristic curve is obtained in the case of the second prior art. In this case, the maximum magnetic flux density on the Z-axis is adjusted to 330 gauss/cm$^2$.

For the purpose of allowing, e.g., the half-value width of the first prior art to be equal to 24 mm, permanent magnet 1 consisting of Alnico of about 160 g is required and it is very difficult to integrally form such a permanent magnet because cracks or nests may occur, with the result that the yield of the product is lowered to less than 50%.

In view of this, in accordance with this invention, for the purpose of allowing the Alnico permanent magnet 1 of the first prior art to have the length of 26 mm, as shown in FIG. 1(*a*), two permanent magnets 1*a* and 1*b* having the thickness of 8 mm are prepared, and a yoke having the same diameter as that of each magnet and a thickness of 8 mm, and containing carbon of 3% is put between the both permanent magnets 1*a* and 1*b* in a stacked manner, and is joined and fixed thereto.

Figure 2:
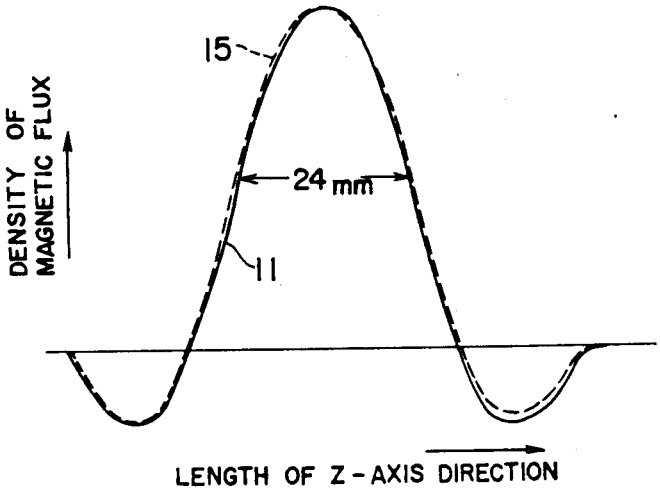
FIG. 2 is a magnetic flux density distribution diagram of an embodiment according to this invention.

Referring to FIG. 2, there is shown in a comparative manner the magnetic flux density distributions on the Z-axis using the permanent magnet of this invention (the characteristic curve 11 indicated by the solid line) and the integrally formed permanent magnet of the first prior art (the characteristic curve 15 indicated by dotted lines).

Since it is seen that the both magnetic density distributions are substantially the same as indicated by the characteristic curves 11 and 15, there is not produced any difference between effects as the electronic lens of the both permanent magnets.

Figure 3:
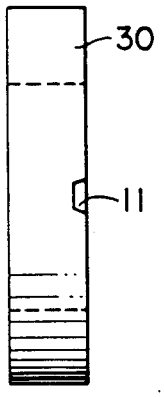
FIG. 3 shows the structure of another embodiment according to this invention wherein FIG. 3(*a*) is a side view and FIG. 3(*b*) is a plan view partially cut.
Figure 3:
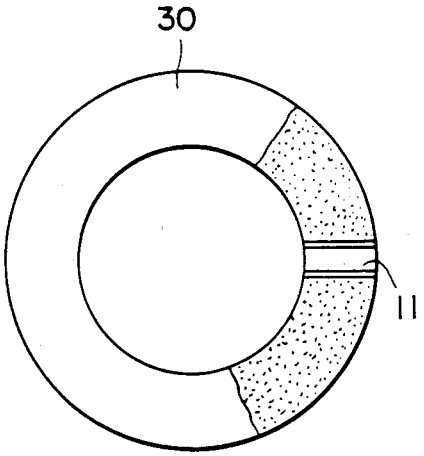

The structure of another embodiment according to this invention is shown in FIG. 3 wherein FIG. 3(*a*) is a side view and FIG. 3(*b*) is a plan view partially cut.

Ring-shaped permanent magnets 1*a* and 1*b* are comprised of Alnico magnet (Alnico 8 . . . tradename . . . ) having an outer diameter of 58 mm, an inner diameter of 48 mm, and a thickness of 8 mm. Onto the outside both end surfaces, ring-shaped magnetic pole pieces 2*a* and 2*b* having an outer diameter of 56 mm, an inner diameter of 33 mm, and a thickness of 3 mm are joined and fixed, respectively.

A coil 5 having about 530 turns of insulating copper wires having a diameter of 0.18 mm is mounted on a heat-resisting bobbin 4.

At the end surfaces of a ring-shaped sintered body and yoke 30 of sintered material having the same outer and inner diameters as those of the ring-shaped permanent magnets 1*a* and 1*b*, a groove (take-out groove 10) having a width of 2 to 3 mm and a depth of 2 mm is opened by the forming metal mold for sintered body.

The sintered body and yoke 30 consists of Fe (iron) as its major component including Si element of 3.08% and its electric intrinsic resistivity is 35 microohm-centimeter.

In the following Table, there is shown unevenness of the strength of the magnetic field by the magnetic flux 9 of (a) the permanent magnet for electronic lens according to this invention made up in this way (which will be referred to as "the method according to this invention") and (b) a conventional magnet comprising the steps of making up yoke 3 (although it has no take-out groove 10), e.g., using a conventional low percentage carbon steel including C element of 0.25% to bore take-out hole 6 of 2.5 mm at either the magnetic pole piece 2*a* or 2*b* in order to take out the lead wire 7 (which will be referred to as "conventional method").

In the above Table, the polarized magnetization factor is defined as (max. value−min. value)/(max. value)×100.

It is seen from this table that the unevenness of magnetic field in this invention is clearly smaller than that in the prior arts.

The measured result when this invention is applied to an electron beam projector will be now described in comparison to the prior art.

When a typical electron beam projector (which will be referred to as "conventional method") and that of this invention are set and powered under the same condition, the surface temperature at the socket side magnetic pole piece was measured by a thermocouple.

The results thus obtained are represented by the characteristic curve of the method according to this invention designated at 21 and that of the conventional method designated at 22.

It has been clearly seen that an elevation of the temperature in the case of the method according to this invention is smaller than that in the case of the conventional method.

According to the present invention, various advantages can be achieved as follows, and therefore it is apparent that the invention can contribute much to the related field of industry.

(1) In accordance with this invention, since the permanent magnets on the both sides which are stacked and connected with the yoke being interposed therebetween in a traveling direction of the electron beam may have a thickness considerably thinner than that of the prior art, they are easy to manufacture and have improved quality and increased reliability. In addition, its cost is extremely reduced, and the characteristic is considerably made by the various properties of the yoke.

(2) Further, in accordance with this invention, the lead wire of the coil assembled in the ring-shaped permanent magnet and the ring-shaped yoke, and wound on the cylindrical bobbin can be taken out to the outside without disturbing the magnetic field distribution, and it is easy to open a take-out groove in the yoke. In addition, since the yoke consists of a sintered body, the constituent added therein increases the electric intrinsic resistance, thus making it possible to considerably suppress elevation of temperature based on eddy current loss.

What is claimed is:

1. A permanent magnet for an electronic lens including two ring-shaped permanent magnets individually magnetized in a Z-axis direction which is the center axis direction of the ring, and connected in a direction of the same magnetic pole so that the magnetic moments are oriented in the same direction to a passing direction of an electron beam, thus allowing the electron beam to travel and pass through a ring-shaped internal hole, wherein a yoke comprising a ferromagnetic body having substantially the same inner and outer diam-

| | STRENGTH (gauss) OF MAGNETIC FIELD IN THE CENTER | STRENGTH (gauss) OF MAGNETIC FIELD AT POSITION 10 mm SPACED FROM THE CENTER | | | | | | | | POLARIZED MAGNETIZATION FACTOR |
|---|---|---|---|---|---|---|---|---|---|---|
| | | 1 | 2 | 3 | 4 | 5 | 6 | 7 | 8 | |
| CONVENTIONAL | 327 | 377 | 372 | 376 | 377 | 379 | 376 | 377 | 378 | 1.8 |
| METHOD | 330 | 379 | 371 | 375 | 378 | 379 | 374 | 376 | 374 | 2.1 |
| METHOD OF | 328 | 379 | 378 | 378 | 379 | 379 | 378 | 378 | 379 | 0.2 |
| INVENTION | 329 | 380 | 379 | 379 | 380 | 381 | 379 | 379 | 380 | 0.52 |

eters of those of adjacent ring-shaped permanent magnets with said yoke being held therebetween, and having a length which is about from half to three times compared with one of said ring-shaped permanent magnets, thereby to increase the half-value width of the magnetic flux density distribution of the Z-axis.

2. A permanent magnet for an electronic lens as set forth in claim 1, wherein said yoke is comprised of a sintered alloy and is provided with a groove for taking out a lead wire of a coil assembled in said yoke and said ring-shaped permanent magnets.

3. A permanent magnet for an electronic lens as set forth in claim 2, wherein the magnetism conductive ferromagnetic yoke used in said permanent magnet for electronic lens is comprised of a sintered body having an electric resistance of more than 20 microohm centimeter.

4. A permanent magnet for an electronic lens as set forth in claim 2, wherein said groove is provided in a direction having no effect on magnetic flux passing through said yoke.

5. A permanent magnet for an electronic lens as set forth in claim 2, wherein said groove is provided, in a radial direction of said yoke.

* * * * *